US007559344B2

(12) United States Patent
Bamelis et al.

(10) Patent No.: US 7,559,344 B2
(45) Date of Patent: Jul. 14, 2009

(54) DEVICE AND METHOD FOR STRETCHING

(75) Inventors: Jean Marie Bamelis, Ieper (BE); Chris Delanote, Ieper (BE); Jozef Peeters, Ieper (BE)

(73) Assignee: Picanol N.V., Ieper (BE)

( * ) Notice: Subject to any disclaimer, the term of this patent is extended or adjusted under 35 U.S.C. 154(b) by 328 days.

(21) Appl. No.: 10/539,809

(22) PCT Filed: Nov. 27, 2003

(86) PCT No.: PCT/EP03/13338

§ 371 (c)(1),
(2), (4) Date: Jun. 20, 2005

(87) PCT Pub. No.: WO2004/059055

PCT Pub. Date: Jul. 15, 2004

(65) Prior Publication Data

US 2006/0151047 A1 Jul. 13, 2006

(30) Foreign Application Priority Data

Dec. 20, 2002 (DE) ..... 102 61 774

(51) Int. Cl.
*D03D 45/50* (2006.01)
*D03D 49/50* (2006.01)

(52) U.S. Cl. ..... 139/116.1; 139/194; 139/435.1

(58) Field of Classification Search ..... 139/116.1, 139/194, 435.1
See application file for complete search history.

(56) References Cited

U.S. PATENT DOCUMENTS

| | | | | |
|---|---|---|---|---|
| 3,901,286 | A | 8/1975 | Vermeulen et al. | |
| 3,908,710 | A | 9/1975 | Van Mullekom | |
| 4,962,796 | A * | 10/1990 | Grimm et al. | 139/450 |
| 5,012,844 | A * | 5/1991 | Griffith | 139/452 |
| 5,226,458 | A * | 7/1993 | Bamelis | 139/194 |
| 6,009,915 | A * | 1/2000 | Schaich et al. | 139/28 |
| 6,014,990 | A * | 1/2000 | Bamelis et al. | 139/194 |

FOREIGN PATENT DOCUMENTS

EP 0 335 011 A2 10/1989

* cited by examiner

*Primary Examiner*—Bobby H Muromoto, Jr.
(74) *Attorney, Agent, or Firm*—Bacon & Thomas, PLLC

(57) ABSTRACT

A thread stretching device for a weaving machine, especially an air jet weaving machine, includes a thread gripper (22) for gripping the weft thread (10) as a device for stretching a weft thread inserted into a shed. A mechanism (23) for deflecting the weft thread is arranged upstream of the thread gripper, relative to the weft thread transport direction.

25 Claims, 2 Drawing Sheets

DEVICE AND METHOD FOR STRETCHING

BACKGROUND

1. Field of the Invention

The invention relates to an apparatus and a method for stretching a weft thread inserted into a weaving shed, in particular for air-jet weaving machines.

Weft threads are inserted into a weaving shed at high speeds. Because of the driving forces and because of the braking forces at the end of the weaving insertion, the weft threads become elastically elongated. Because of this elongation, the weft threads have the tendency, after the end of the weft insertion, to snap back into the shed and to form loops or snarls there. Such snarls or loops result in weave faults. To prevent the weft thread from snapping back, so-called stretching nozzles are typically disposed on the side of the shed opposite the insertion side. They are using an air stream, tension the inserted weft thread and keep it stretched. This tensioning and stretching can be further improved by keeping so-called auxiliary blow nozzles or relay nozzles activated for a certain time after the weft insertion. For exerting a sufficient force for the stretching a relatively long length of weft thread must be taken up by the stretching nozzle. Moreover, the air consumption of a stretching nozzle of this kind is relatively high.

2. Related Art

The object of the invention is create an improved device for keeping an inserted weft thread tensioned or stretched.

SUMMARY OF THE INVENTION

This object is attained by providing at the side of the shed opposite the insertion side a thread clamp actuatable by means of a control unit for clamping the weft thread, upstream of which—in terms of the weft thread insertion direction—a device for deflecting the weft thread actuatable by means of said control unit is disposed.

In a preferred embodiment, the thread clamp and the deflector device are both disposed on the same side of the shed, that is, on the side of a shed opposite the insertion side. On that side, the risk that snarls or loops will be created is especially high.

By means of the thread clamp, the inserted weft thread is prevented from snapping back into the shed. Since it will not be possible in most cases to clamp the weft thread exactly at the moment when it has completed its insertion motion yet has not moved backward again, a device for deflecting and tensioning the thread is provided. This device assures that the weft thread will be kept stretched even if it has already moved some distance backward again. In this way the tension of the weft thread is essentially maintained the same over the weaving width, so that good quality of the woven fabric is attained.

In a further embodiment of the invention, a device for detecting insertion of the weft is provided, the output signal of which is converted into actuation signals for the thread clamp and the deflector device. Since differences can occur between insertion motions of the weft threads, it is advantageous if the actuation of the thread clamp and of the deflector device be effected as a function of the detected motion of the weft thread, since then a better timing adaptation is possible.

Another advantageous embodiment of the invention includes using a detector of a prewinder as the device for detecting the motion of the weft thread which detects the number of windings of the weft thread drawn off the prewinder for each weft insertion. Thus a signal is generated on the insertion side, so that even at very high weaving speeds, enough time remains for actuating the thread brake and the deflector device in time. As a further feature of the invention, the magnitude of the deflection force of the device for deflecting the weft thread is adjustable, controllable or regulatable. Thus an adaptation to weft threads with different materials is possible, so that a weft thread can be stretched sufficiently without breaking. For the sake of adaptation to weft threads of different materials, in a further embodiment of the invention the course of the deflection force is adjustable during the deflection of the weft thread. For instance, in accordance with such further embodiment of the invention, at least two devices can be provided for deflecting the weft thread that are actuatable independently of each another. Deflector devices that are actuatable independently may optionally also be appropriate whenever the materials of two weft threads to be inserted successively are different to such an extent that a different deflection force for each of them is appropriate, but yet this different deflection force cannot be achieved by varying the adjustment of a single deflector device.

According to a further feature of the invention, a method for stretching is provided, whereby the weft thread is clamped approximately at the end of its insertion on the side of the shed opposite the insertion side and is then kept tensioned by its deflection until it is beaten up.

DESCRIPTION OF THE DRAWINGS

Further characteristics and advantages of the invention will become apparent from the ensuing description of the exemplary embodiments shown in the drawings and from the dependent claims.

DETAILED DESCRIPTION OF THE PREFERRED EMBODIMENT OF THE INVENTION

Figure 1:
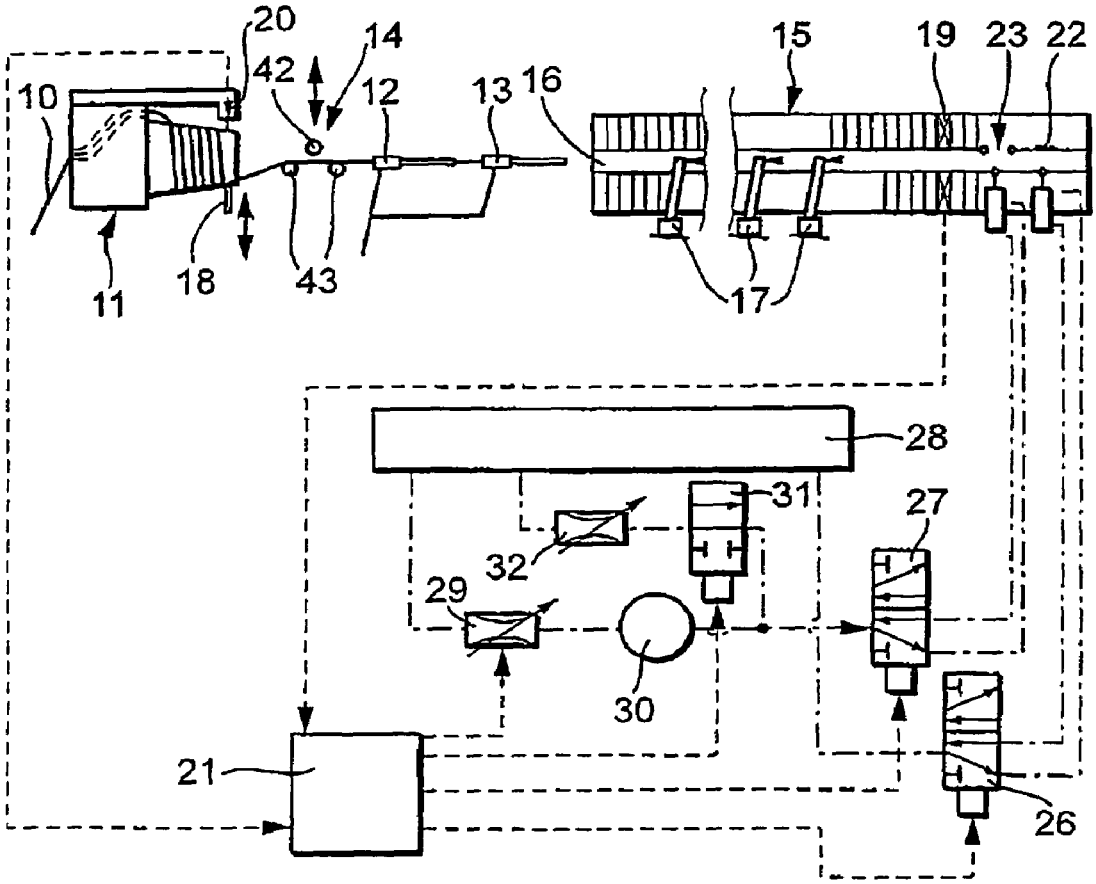
FIG. 1 schematically shows the construction of an apparatus according to the invention for an air-jet weaving machine.

In an air-jet weaving machine of the kind shown in part in FIG. 1, a weft thread 10 is drawn from a supply bobbin, not shown, by means of a prewinder 11 and wound up in a plurality of windings onto a drum of the prewinder. The weft thread 10 is kept in readiness in two main blower nozzles 12, 13. A thread brake 14 is disposed between the prewinder 11 and the main blower nozzles 12, 13. By means of the main blower nozzles 12, 13, the weft thread is blown into a shed that is formed of warp threads, not shown, in the region of a reed 15. The reed 15, which has many ribs spaced closely together, forms a weft thread guide duct 16. To that end, the ribs are each provided in a known manner with a U-shaped recess which opens toward the edge of the woven fabric, not shown. The motion of the weft thread 10 along the weft thread transport guide duct 16 is reinforced by auxiliary nozzles or relay nozzles 17, which each aim a jet of air into the weft thread transport duct 16.

When a weft thread 10 is to be inserted into the shed, a pin 18 on the drum of the prewinder 11 is released. The main blower nozzles 12, 13 are supplied with compressed air. The relay nozzles 17 are likewise provided with compressed air in groups, one after the other. Once the weft thread 10 reaches the side of the shed opposite the insertion side, this event is signaled by a weft thread detector 19. Before the weft thread 10 reaches the opposite end of the shed, it has been already braked by means of the thread brake 14. The actuation of the thread brake 14 is controlled by means of a detector 20, which counts the number of windings of weft threads that have been drawn from the drum of the prewinder 11 upon insertion of the weft thread. The insertion of the weft threads, that is, the release of the thread pin 18, actuation of the supply of compressed air into the main blower nozzles 12, 13, and the action of the relay nozzles 17, are controlled in a known manner via a control unit 21, to which the weft thread detector 19, which signals the arrival of a weft thread on the side opposite the insertion side, is connected.

Weft threads typically comprise a relatively elastic material. Because of the high weaving machine operating speeds, they become elongated elastically upon being inserted into a shed and particularly upon braking at the end of the weft insertion. This elastic elongation is the reason why an inserted weft thread has the tendency to snap back into the interior of the shed, or into the interior of the weft thread guide duct 16. In that region, it then forms loops that cause a flaw in the weave.

To prevent this snapping back and to hold the weft thread in such a way that it is beaten up in stretched form against the edge of the woven cloth with the aid of the reed 15, a thread clamp 22 is provided which grasps and clamps the inserted weft thread 10 on the side of the shed opposite the insertion side. Since it is not assured that the inserted weft thread will be grasped with precise timing, or in other words while it is still initially stretched, a weft thread deflecting device 23 is also provided ahead of the thread clamp 22 on the side of the shed opposite the insertion side. With this deflecting device the weft thread 10 is deflected and thus tensioned. The thread clamp 22 and the deflecting device 23 are designed and disposed in such a way that they do not hinder the insertion of a weft thread. Their individual elements, which will be described in further detail hereinafter, are disposed along the direction of the weft thread transport duct 16 and outside its boundary. They are actuated by the control unit 21 in such a way that they act on the weft thread 10 once the weft thread has been inserted, and release it in good time once the sley, with the reed, moves back toward the beat-up edge of the cloth. It is thus possible for the weft thread 10 to be maintained substantially uniform tensioned over the entire width of the shed so that good quality of the woven cloth is attained.

The control unit 21 generates an actuation signal for the thread clamp 22 and the deflecting device 23 as a function of the detection of the weft thread 10 upon its insertion. In order to provide a sufficiently long period of time for the actuation of the thread clamp 22 and the device 23, the motion of the weft thread 10 may be detected on the weft insertion side. In an exemplary embodiment, this is done by means of the detector 20, which counts the windings drawn from the drum of the prewinder 11 during the weft thread insertion. Preferably, the control unit 21 generates the actuation signal for the thread clamp 22 and the device 23 as a function of the signal that corresponds to detection of the next-to-last winding drawn off. The beginning and the end of the actuation of the thread brake 22 and of the device 23 is adjustable via the control unit 21, so that an adaptation can be made to the material comprising the weft threads and/or to the type of weave pattern.

Figure 2:
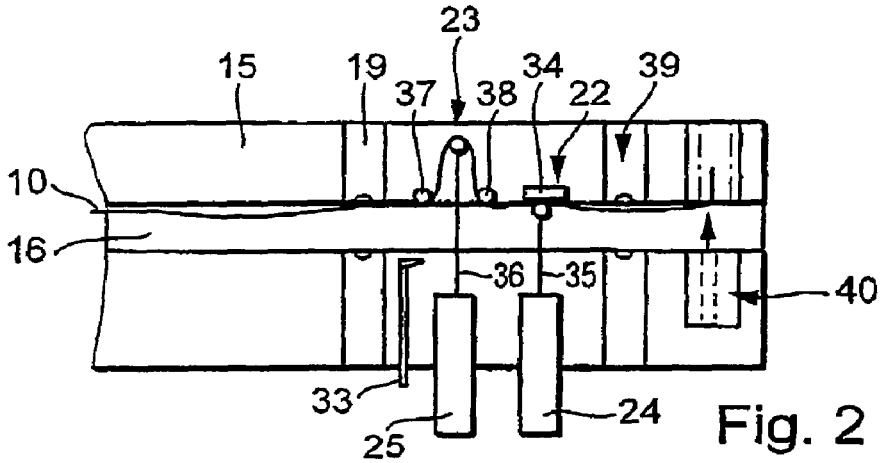
FIG. 2 is a fragmentary view of the embodiment of FIG. 1, on a larger scale.
Figure 3:
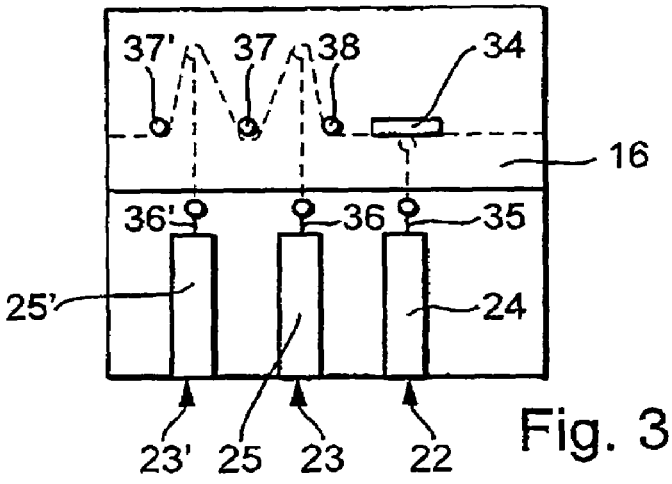
FIG. 3 is a fragmentary view of a modified apparatus.

In the exemplary embodiment of FIGS. 1 and 2, as actuation devices for the thread clamp 22 and the device 23, pneumatic piston-cylinder units 24, 25 are provided which have very short switching times, since between the beginning and end of actuation only relatively short lengths of time are available, on an order of magnitude of 20 ms. The piston-cylinder units 24, 25 in the exemplary embodiment are driven in both directions by compressed air, so that there are no restoring springs.

The beginning and end of actuation of the thread clamp 22 and the device 23 are determined by the control unit 21, which controls the supply of compressed air to the piston-cylinder units 24, 25 via solenoid valves 26, 27. The solenoid valves 26, 27 are preferably 5/3-way valves.

Figure 5:
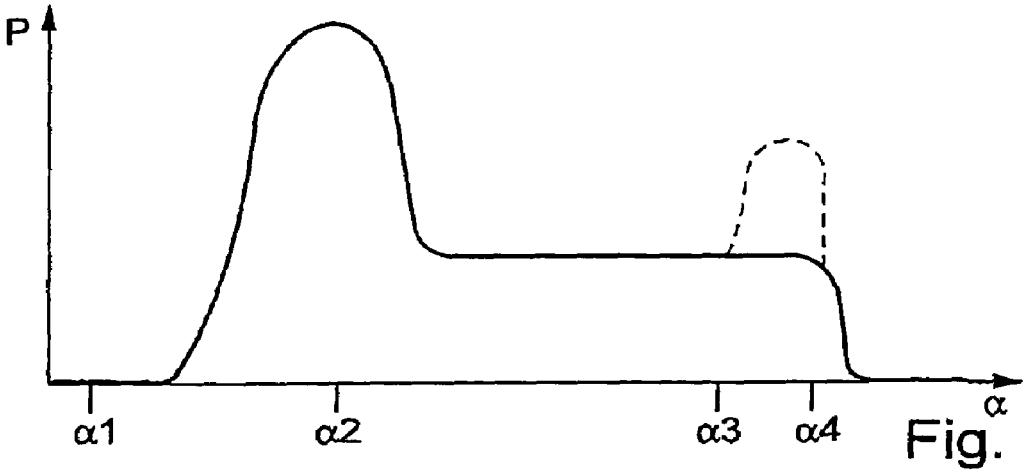
FIG. 5 is a graph showing the course of a deflection force during the stretching of an inserted weft thread.

A compressed air reservoir or tank 28 serves as a source of compressed air; in it, compressed air is stored at relatively high pressure, such as 6 bar. The piston-cylinder unit 24 of the thread clamp 22 is supplied with the high pressure air directly via the valve 26, so that very short switching times for the thread clamp 22 can be attained. The piston-cylinder unit 25 for the deflector device 23 is conversely acted upon by a variable pressure. The target pressure variation curve is as shown for example in FIG. 5. At the beginning of the actuation, the piston-cylinder unit 25 of the device 23 is subjected to a high pressure, in order to initiate the motion as fast as possible. After that, the pressure is reduced to a lesser value, so that the force with which the weft thread 10 is kept tensioned is reduced. Optionally, a pressure increase is then applied again toward the end of the actuation. In the exemplary embodiment of FIG. 1, the pressure variation curve shown in FIG. 5 is attained by using a throttle valve 29 and a small reservoir 30 in advance of the solenoid valve 27. As soon as the solenoid valve 27 blocks the line to the piston-cylinder unit 25 in the piston extension direction, a pressure builds up in the small reservoir 30 that is substantially equivalent to the pressure in the compressed air tank 28. If the solenoid valve 27 establishes communication with the piston-cylinder unit 25 in the extension direction, then the piston-cylinder unit is briefly acted upon by the full pressure until the reservoir 30 has been emptied to such an extent that it is refilled with the pressure throttled by the throttle valve 29. The result is the pressure curve shown in a solid line in FIG. 5; that is, the actuation begins at a peak pressure, after which the pressure decreases to the throttled value. The throttling of the throttle valve 29 is preferably adjustable via an input device and the control unit 21, so that an adaptation can be made for various materials comprising the weft threads and/or to different weaves. The throttle position of the throttle valve 29 may also be adjusted, controlled or regulated during weaving.

If the second peak pressure toward the end of actuation of the device 23, shown in dashed lines in FIG. 5, is desired, or in other words an increased deflection force, then in accordance with an exemplary embodiment of FIG. 1 this is attained by providing that the control unit 21, by means of a solenoid valve 31 of the piston-cylinder unit 25, switches on a second compressed air delivery. An adjustable throttle valve 32 is connected upstream of the solenoid valve 31 acting as a blocking valve; this throttle valve is set to a higher pressure value than the throttle valve 29. The actuation of the solenoid valve 31 may be effected by the control unit 21 based on a predetermined setting of a length of time or angular position of the main shaft of the weaving machine. In the exemplary embodiment of FIGS. 1 and 2, however, a position detector 33 is associated with the piston of the piston-cylinder unit 25 of device 23, which, as a function of the position of the piston or at a predetermined position, outputs a signal that causes the second peak pressure to occur.

The beginning and end of actuation of the thread clamp 22 and of the device 23 may be effected at predetermined lengths of time after the signal of the detector 20 is generated. Preferably, however, the beginning and end of actuation are also determined as a function of the angular positions a of the main shaft of the weaving machine, since the motion of the sley and hence of the reed 15 is also associated with these angular positions. To adjust the actuation, the length of time between the arrival of the weft thread at the weft thread detector 19 and the generation of the signal by the detector 20 may also be taken into account.

Figure 6:
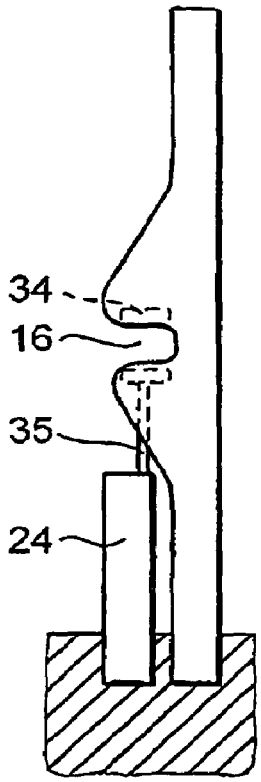
FIG. 6 is a view of the apparatus of FIG. 1 as viewed counter to the weft thread transporting direction.

The elements of the thread clamp 22 and of the device 23 are disposed on the sley of the weaving machine which carries the reed 15. The arrangement is made such that when the elements are in their at-rest position, they are located outside the boundary of the weft thread guide duct, as can be seen in FIG. 6. As seen from FIG. 2, a stationary clamping part 34 is located above the weft thread guide duct 16. The piston-cylinder unit 24 is located far enough below the weft thread guide duct that the outermost end of the piston 35, in the at-rest position, is located below the guide duct 16. The piston-cylinder unit 25 is likewise disposed below the guide duct 16 in such a way that the piston 36, in the at-rest position, is located entirely below the guide duct 16. The device 23 includes two deflection elements 37, 38, which are located above the guide duct 16. The piston 36, together with the weft thread 10, are movable into the region between the two deflection elements 37, 38 and the piston carries the weft thread 10 along with it. The deflection travel of the weft thread 10 is therefore twice the length of travel of the piston 36.

As is further shown in FIG. 2, the thread clamp 22 may be followed by a further weft thread detector 39. A stretching nozzle 40 may also be located at the end of the weft thread guide duct 16. This nozzle blows a jet of compressed air from a blow opening located below the guide duct 16, together with the end of the weft thread, into a tube extending perpendicular to the guide duct 16 and located above the guide duct 16. In a modified embodiment, the tube and the blow opening are oriented obliquely or parallel to the guide duct 16.

If a longer deflection travel is necessary for deflecting and tensioning the weft thread adequately, then two devices 23 and 23' for deflecting the weft thread may be disposed in line with each other. In that case, the device 23' also has a piston-cylinder unit 25', whose piston is movable upward between two stationary deflection elements 37 and 37'. A second device 23' for deflecting an inserted weft thread may also be appropriate if the weaving machine runs at very high speed, and if weft threads of very different material must be inserted successively. In that case, the piston-cylinder unit 25' would have to be equipped with its own solenoid valve and with its own pressure supply line that is triggerable independently of the control unit 21.

Figure 4:
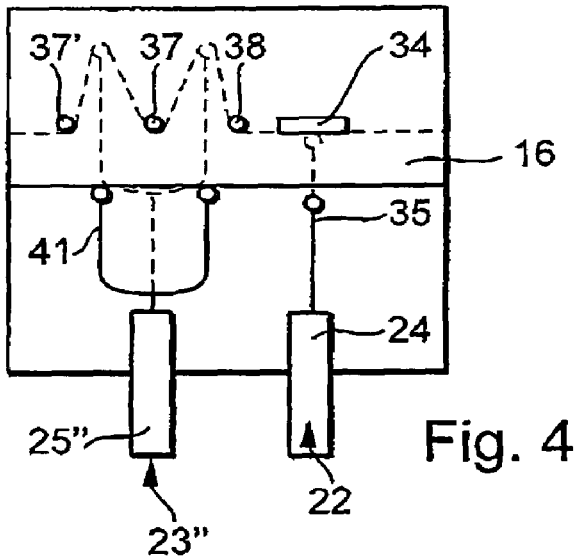
FIG. 4 is a fragmentary view of a still further modified apparatus.

If all that is needed is to provide the longest possible travel for the deflection, then the device 23" of FIG. 4 may be provided. In this device 23", the piston-cylinder unit 25" is provided with a forklike piston 41, the two tines of which are movable in between the deflection elements 37', 37 and 38.

Instead of the pneumatic piston-cylinder units 24 or 25, whose forces are readily adjustable, still other actuating elements for the thread clamp 22 and the device 23 for deflecting and tensioning may be employed. As actuating elements, electric motors may be used, especially linear motors or proportional motors or similar electromagnetic drive mechanisms, whose force or torque, which determines the deflection force, is dependent on the energy supplied. For the thread clamp 22, an electromagnetic drive mechanism may also be provided. As the device for deflecting and tensing a weft thread, it is also possible to provide one or more blower nozzles, which blow a weft thread in between deflection elements and in the process deflect and tension it.

To speed up the motion of the piston-cylinder units 24, 25, it is possible, by means of the solenoid valves 26, 27, to make each line acting as a return line not to communicate with the atmosphere but instead to connect it to a suction means.

The apparatus according to the invention also makes it possible to repair a weft thread break, for instance in accordance with German Patent Disclosure DE 37 30 480, without hindrance. For this repair of a weft thread break, the apparatus is not actuated, so that all the elements are in a position in which a weft thread can move freely through the guide duct 16.

In order to have the weft threads come to an end outside the woven fabric with equal ends, a weft thread scissors is provided immediately after the weft thread detector 19.

In the exemplary embodiments described above, the device 23, 23' or 23" has in each case been located on the side of the shed opposite the insertion side, that is, on the side facing away from the prewinder 11. However, it is also possible for a deflector device to be located on the insertion side. To that end, the thread brake 14 present on the insertion side may also be employed, which is controlled such that it deflects the inserted weft thread after the actuation of the thread clamp 22. The thread brake in this case has an adjustable deflection element 42, which is movable in between two stationary deflection elements 43.

If two lengths of woven fabric are woven side by side on the same weaving machine, then a single deflector device may be placed between the two woven fabrics. The deflector device may in principle be located at any arbitrary point between the pin 18 and the thread clamp 22.

A plurality of devices for deflecting the weft thread may also be used as a deflector device, such as the device 23, shown in FIG. 1, and the thread brake 14, also shown in FIG. 1. By means of a plurality of deflector devices, it is possible to take up even relatively great lengths of thread within a very short time.

The invention claimed is:

1. An apparatus for stretching a weft thread inserted into a weaving shed of a weaving machine, for example an air-jet weaving machine, comprising a thread clamp disposed on that side of the weaving shed opposite the insertion side actuatable by means of a control unit for clamping the inserted weft thread, and further comprising upstream of said clamp, relative to the weft thread transporting direction and on the same side of the shed as said clamp, a deflecting device actuatable by said control unit for deflecting the weft thread, said thread clamp and said deflecting device being separately actuatable, such that said thread clamp prevents an inserted weft thread from snapping back into the shed.

2. The apparatus according to claim 1, wherein the thread clamp and the deflecting device for deflecting the weft thread are disposed next to each other.

3. The apparatus according to claim 1, including at least one weft thread motion detecting device, wherein a signal generated by said weft thread motion detecting device is converted into actuation signals for the thread clamp and the deflecting device for deflecting the weft thread.

4. The apparatus according to claim 3, including a prewinder weft motion detector that comprises the weft thread motion detecting device, said prewinder weft motion detector arranged to detect the number of windings of the weft thread drawn off from a prewinder by each weft insertion.

5. The apparatus according to claim 1, wherein the magnitude of a deflection force exerted by the device for deflecting the weft thread is adjustable, controllable or regulatable.

6. The apparatus according to claim 1, wherein the course of the deflection force exerted by the deflecting device for deflecting the weft thread is adjustable or regulatable.

7. The apparatus according to claim 1, wherein two or more deflecting devices for deflecting the weft thread are provided between a weft thread stopper and the thread clamp.

8. The apparatus according to claim 1, including at least two deflecting devices for deflecting the weft thread that are actuatable independently of each other.

9. The apparatus according to claim 1, wherein the beginning and/or the end of the actuation of the thread clamp is variable.

10. The apparatus according to claim 1, wherein the beginning and/or the end of the actuation of the deflecting device for deflecting the weft thread is variable.

11. The apparatus according to claim 1, wherein the thread clamp and the deflecting device for deflecting the weft thread are disposed on a sley of the weaving machine.

12. The apparatus according to claim 11, wherein the sley carries a reed having a weft guide duct, and the thread clamp and the deflecting device for deflecting the weft thread are disposed along an extension of said weft guide duct.

13. The apparatus according to claim 12, wherein the elements of the deflecting device for deflecting the weft thread and elements comprising the thread clamp are disposed, in their at-rest position, outside the boundary of the weft thread transport duct.

14. The apparatus according to claim 1, wherein the deflecting device for deflecting the weft thread comprises, as its actuating device, at least one pneumatic piston-cylinder unit.

15. The apparatus according to claim 14, wherein a piston of the piston-cylinder unit is drivable in both directions with compressed air.

16. The apparatus according to claim 14, including a device for detecting the position of the piston of the piston-cylinder unit of the deflecting device for deflecting the weft thread.

17. The apparatus according to claim 14, including means that determine the level of the pressure and/or the variation over time of the pressure that is delivered to the piston-cylinder unit of the deflecting device for deflecting the weft thread.

18. The apparatus according to claim 14, wherein the piston-cylinder unit of the deflecting device for deflecting the weft thread is connectable selectively via a switching valve to at least two delivery lines for compressed air.

19. The apparatus according to claim 1, including a pneumatic piston-cylinder unit comprising the actuating device for the thread clamp.

20. The apparatus according to claim 19, wherein a piston of the piston-cylinder unit is drivable with compressed air in both directions.

21. A method for stretching a weft thread after its insertion into a weaving shed of a weaving machine, for example an air-jet weaving machine, comprising clamping the weft thread by a clamping device under control of a control unit at a time at least approximately at the end of the insertion on the side of the shed opposite the insertion side and then tensioning the clamped weft thread by deflection of the weft thread at the side of the shed opposite the insertion side by a deflecting device located upstream of the clamping device until it is beaten up, including actuating the clamping and deflecting devices by separate actuators, said clamping device preventing an inserted weft thread from snapping back into the shed.

22. The method according to claim 21, including deflecting the weft thread with a force whose magnitude is controllable or regulatable.

23. The method according to claim 21, including deflecting the weft thread at a plurality of locations.

24. The apparatus according to claim 1, including a thread brake on the weft insertion side of the weaving shed.

25. The method according to claim 21, wherein the step of maintaining the inserted weft thread in tension by deflection of the weft thread is carried out on the side of the shed opposite the insertion side.

* * * * *